US009033771B2

(12) United States Patent
Krent

(10) Patent No.: US 9,033,771 B2
(45) Date of Patent: May 19, 2015

(54) KNIFE SHARPENER

(71) Applicant: Lifetime Brands, Inc., Garden City, NY (US)

(72) Inventor: Adam Krent, Brooklyn, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 146 days.

(21) Appl. No.: 13/774,419

(22) Filed: Feb. 22, 2013

(65) Prior Publication Data

US 2014/0242895 A1 Aug. 28, 2014

(51) Int. Cl.
*B24D 15/08* (2006.01)

(52) U.S. Cl.
CPC ..... *B24D 15/08* (2013.01)

(58) Field of Classification Search
CPC ..... B24D 15/08; B24D 15/081; B24D 15/06; B24D 15/084; B24D 15/063
USPC ..... 451/555, 540, 557, 419, 423, 558, 553; 76/81–89.2; 30/340, 342–344
See application file for complete search history.

(56) References Cited

U.S. PATENT DOCUMENTS

| | | | | | |
|---|---|---|---|---|---|
| 56,615 | A | * | 7/1866 | Russ | 76/82.2 |
| 70,360 | A | * | 10/1867 | Reynolds | 76/86 |
| 331,853 | A | * | 12/1885 | Warren | 76/81 |
| 371,689 | A | * | 10/1887 | Kisner | 76/82.2 |
| 402,033 | A | * | 4/1889 | Pomeroy | 76/81 |
| 823,279 | A | * | 6/1906 | Kellog | 76/88 |
| 1,134,359 | A | * | 4/1915 | Walker | 76/86 |
| 2,128,591 | A | * | 8/1938 | McGill | 451/321 |
| 2,295,693 | A | * | 9/1942 | Seigh | 451/557 |
| 2,380,539 | A | * | 7/1945 | Miller | 451/557 |
| 2,498,107 | A | * | 2/1950 | Ferguson | 30/342 |
| 2,652,667 | A | * | 9/1953 | Arnold | 451/555 |
| 4,002,089 | A | * | 1/1977 | Granberg | 76/37 |
| 4,094,106 | A | * | 6/1978 | Harris | 451/555 |
| 4,147,918 | A | * | 4/1979 | Ritter et al. | 219/121.14 |
| 4,197,677 | A | * | 4/1980 | Graves | 451/555 |
| 4,242,926 | A | * | 1/1981 | Anton | 76/80.5 |
| 4,558,540 | A | * | 12/1985 | Collins | 451/555 |
| 4,633,552 | A | * | 1/1987 | Eriksson | 407/29.15 |
| 4,799,335 | A | * | 1/1989 | Battocchi | 451/241 |
| 5,163,251 | A | * | 11/1992 | Lee | 451/555 |
| 5,199,225 | A | * | 4/1993 | Esposito | 451/555 |
| 5,357,717 | A | * | 10/1994 | Friel et al. | 451/494 |
| 5,426,999 | A | * | 6/1995 | Seiler et al. | 76/82 |
| 5,431,069 | A | * | 7/1995 | Davis | 76/87 |
| 5,431,070 | A | * | 7/1995 | Thames | 76/88 |
| 5,458,534 | A | * | 10/1995 | Campione et al. | 451/555 |
| 6,048,262 | A | * | 4/2000 | Ray | 451/555 |
| 6,852,014 | B1 | * | 2/2005 | Gleason | 451/45 |
| 2006/0211348 | A1 | * | 9/2006 | Hyde et al. | 451/367 |
| 2008/0039001 | A1 | * | 2/2008 | Evans | 451/558 |
| 2009/0183601 | A1 | * | 7/2009 | Shen | 76/84 |
| 2009/0203301 | A1 | * | 8/2009 | Viscomi et al. | 451/451 |

OTHER PUBLICATIONS

Shun Cutlery website—Aug. 2009.*

* cited by examiner

*Primary Examiner* — George Nguyen
(74) *Attorney, Agent, or Firm* — Tutunjian & Bitetto, P.C.

(57) ABSTRACT

A knife sharpener having an angled bolster for providing predetermined sharpening angles with respect to the sharpening surface is provided. The angled bolster of the knife sharpener preferably includes two different angled surfaces for establishing at least two different predetermined sharpening angles for a cutting implement to be sharpened. The angled bolster is configured to set up the knife sharpening angle at predetermined angles with respect to the sharpening surface.

9 Claims, 6 Drawing Sheets

KNIFE SHARPENER

BACKGROUND

1. Technical Field

The present invention relates to cutlery. More particularly, it relates to a knife sharpener having angled bolsters.

2. Description of the Related Art

Knives are used to cut a variety of items, and most particularly, food items. Those of ordinary skill also recognize that in order for a knife to operate as intended, it must be as sharp as possible in view of the particular blade and design of the same. Although different knives of different materials may require specialized sharpening techniques, among the most important aspect of knife sharpening is the angle at which the blade contacts the sharpening device (or tool).

With hand held knife sharpeners, those of skill in the art will further appreciate that it is very difficult to consistently obtain accurate angular contact between the blade and the sharpener during sharpening, and more particularly at the beginning or start of the sharpening action. This inconsistent angular contact with the sharpening surface will not only result in damage to the blade over the long term, but can also have negative effects as to the slicing accuracy and cleanliness of such slice when the blade has been mis-sharpened.

The knife sharpener of the present invention overcomes the shortfalls of known knife sharpeners.

SUMMARY

According to one implementation, the knife sharpener includes a knife sharpening portion and an angled bolster portion positioned at one end of the sharpening portion. The angled bolster includes at least one predetermined angular surface sloped toward the sharpening portion. The angled bolster is configured to support and position the cutting edge of blade to be sharpened at a predetermined sharpening angle with respect to the sharpening portion.

According to another implementation, the knife sharpener includes a handle, an angled bolster portion integrated into one end of the handle and having at least one angled surface, and a sharpening rod axially extending away from the angled bolster portion. The at least one angled surface is configured to provide a predetermined sharpening angle to a cutting edge of a blade to be sharpened.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figures 1, 2:
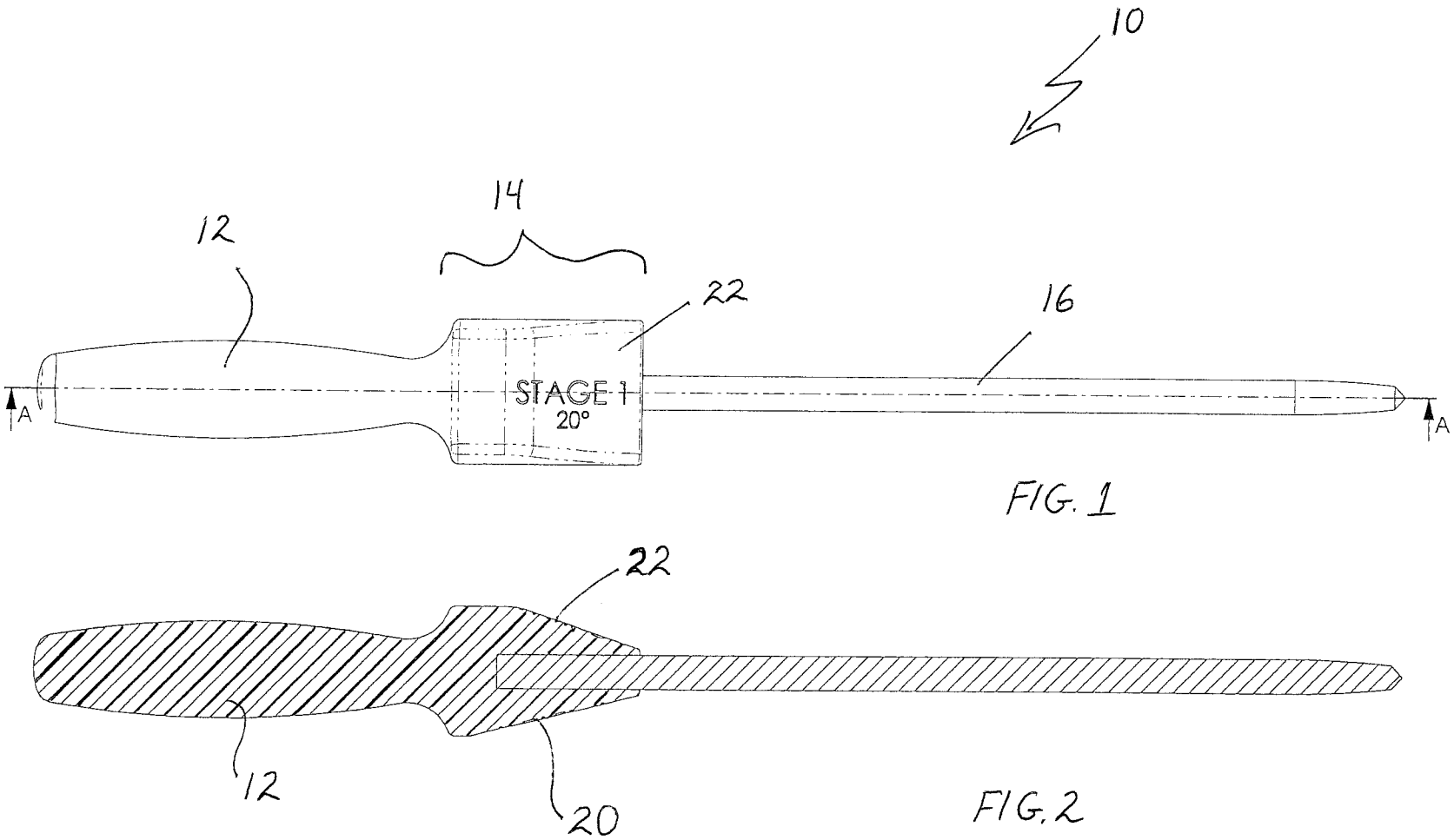
FIG. 1 is a bottom view of the knife sharpener according to an implementation of the present principles.
FIG. 2 is a cross-section view of the knife sharpener of FIG. 1 taken along lines A-A, according to an implementation of the present principles.
Figure 3:
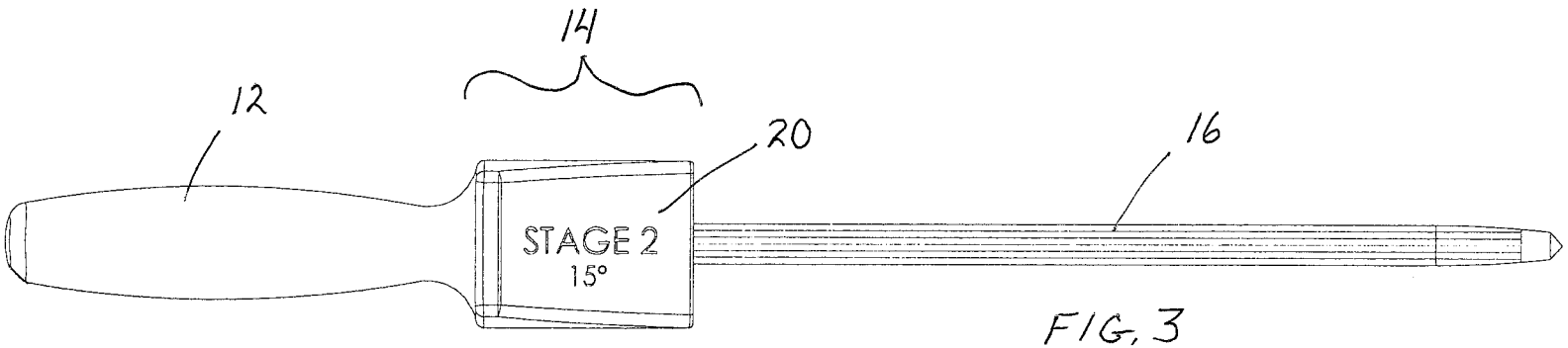
FIG. 3 is a top view of the knife sharpener according to an implementation of the present principles.
Figure 4:
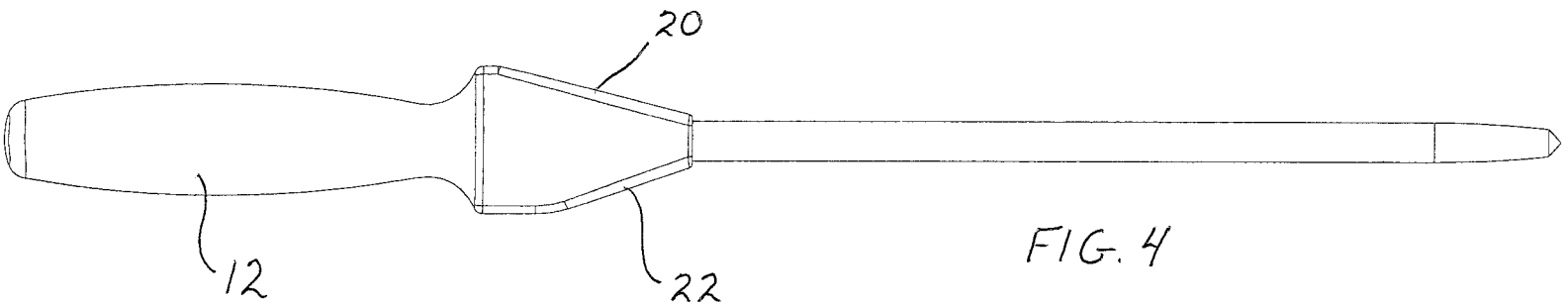
FIG. 4 is a side view of the knife sharpener according to an implementation of the present principles.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

FIGS. 1-4 show the knife sharpener 10 according to one implementation of the present principles. Although shown in the present embodiments and throughout the following description as a hand held sharpener, it is to be understood that the various principles and teachings disclosed herein may be applicable to non-hand held or stationary sharpeners as well.

The knife sharpener 10 is generally made up of a handle 12, an angled bolster portion 14 and a sharpening portion 16. The handle 12 can be made of any suitable material and is configured to allow for a comfortable, yet non-slip grip of the sharpener 10.

Those of ordinary skill in the art will appreciate that sharpening portion is generally formed by a rod 16 and can be made of any known or suitable type of material used for sharpening cutting implements. Sharpening rod 16 may have different sharpening surfaces (e.g., diamond cut) and/or cross-sections (e.g., round, square, triangular, etc.) depending on the desired sharpening or particular cutting implement being sharpened, but as is understood, the material used for the sharpening rod 16 must be harder than that of the cutting implement being sharpened. Those of skill in the art will appreciate that the material for rod 16 can be changed without departing from the intended scope of the invention. By way of only a few examples, the material for rod 16 can be metal, hard coated meal, ceramic or stone.

Figure 6:
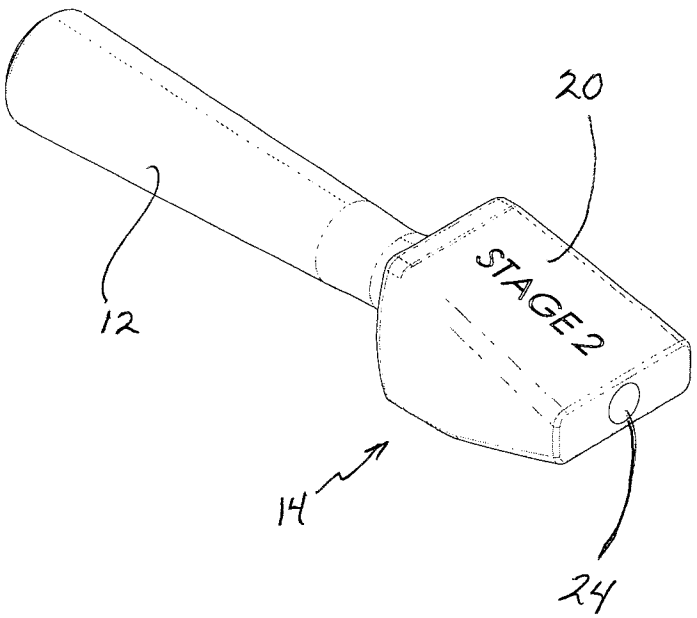
FIG. 6 is a top left perspective view of the knife sharpener handle with angled bolster as shown in FIG. 5 and according to an implementation of the present principles.
Figure 5:
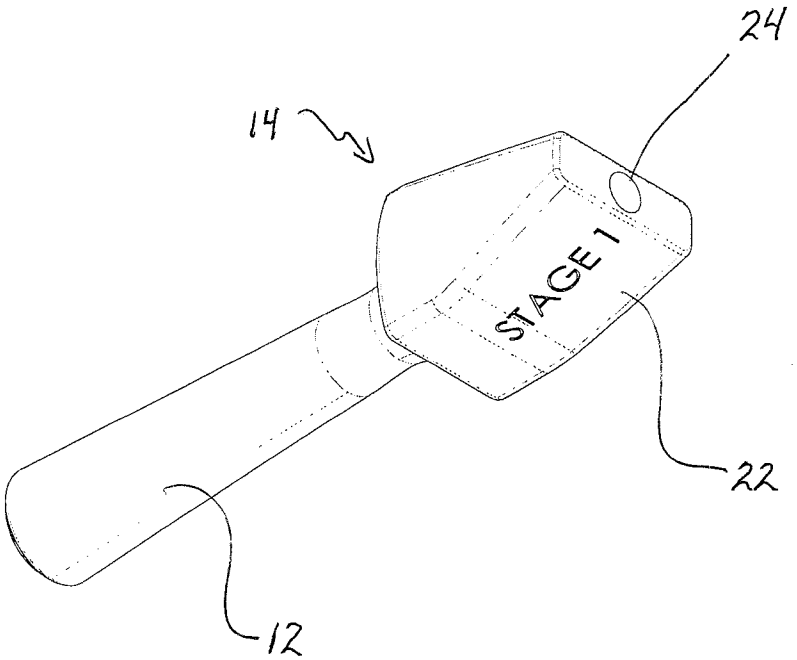
FIG. 5 is a bottom right perspective view of a knife sharpener handle with angled bolster according to an implementation of the present principles.

In addition, it is herein contemplated that the sharpening rod 16 can either be permanently affixed to handle 12 (e.g. during manufacturing), or alternatively, can be releasably attached to the angled bolster portion 14 of the handle 12. With this alternative configuration, the sharpening rod 16 could be exchanged for different sharpening rods, depending on the desired sharpening material or the blades being sharpened. In such an alternative arrangement, the handle 12 will include an opening 24 in the angled bolster portion 14 (See FIGS. 5 and 6). This opening could be configured for a pressure fit of sharpening rod 16, or may include a locking mechanism (not shown) which is integrated into the handle 12, and may include an engage/release button or latch to selectively lock/unlock various sharpening rods to and from the handle. Examples of such locking mechanisms can include, for example, push pin locking systems using ball bearings; a mating notch and slot configuration, full-threaded, partial turn lock, the use of mechanical hardware (e.g., set screws, etc.) and/or a mechanical snap fit. Alternatively, opening 24 and the corresponding portion of the sharpening rod could be threaded such that the different rods 16 can be threadably engaged into the bolster portion 14.

As will be apparent from FIGS. 1-6, the angled bolster portion 14 has at least two distinct angled surfaces 22 and 20, or stages 1 and 2, respectively. The design of the angled bolster 14 creates, or more accurately "sets up" the proper angular position of the blade to be sharpened with respect to the sharpening rod. Once this angular position or angular relationship has been established/set, it will allow for the user to safely guide the blade toward the sharpening rod at that angle and away from the user (i.e., conventional sharpening action).

In these and the following example, specific angles for the angled surfaces 22 and 20 have been chosen, i.e., 15° and 20° for surfaces 20 and 22, respectively. Those of skill in the art will appreciate that the specific angles of the bolster 14 can be adjusted to cover the range of common blades and materials for proper edge alignment for all knives, as well as other cutting implements. By way of example, the preferred range of angles for any one of the angled surfaces in order to create a functioning cutting edge would be 10°-30°, however it is herein contemplated that this range could be extended to be 5°-35° in special cases (e.g., where it may be required to sharpen a blade in angular stages such as 5° first, 10° second, etc.). These guide angles can be particular and unique to both single and/or double sided cutting edges (e.g., sharpeners included with specific sets of blades).

Figure 7A:
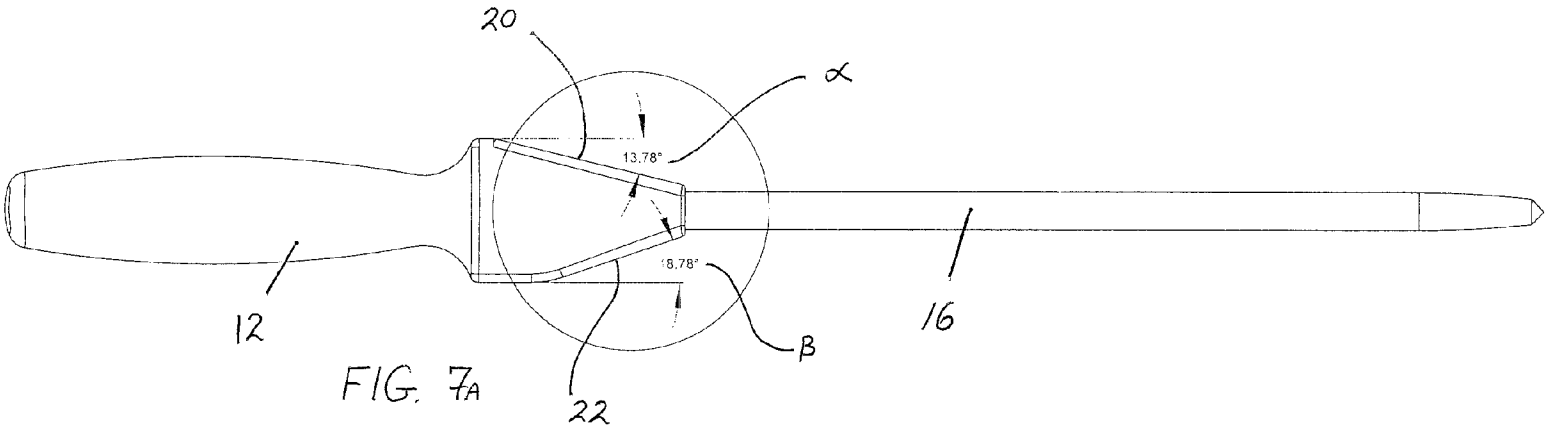
FIGS. 7A and 7B show the angled bolster portion of the knife sharpener according to one preferred implementation of the present principles.
Figure 7B:
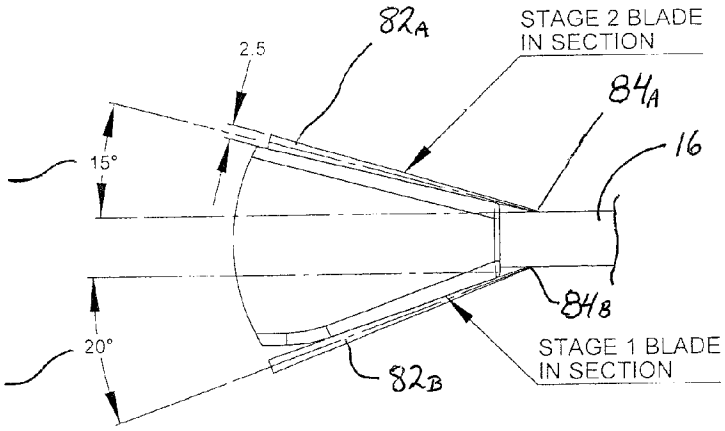

Referring to FIGS. 7A and 7B, it will become apparent that in order to configure the angled surfaces 20 and 22 to provide a predetermined angular contact with the sharpening rod (e.g., 15° and 20° in the present example), consideration of the thickness of the blade being sharpened is preferred. For example, as shown in FIG. 7A, the angle $\alpha$ corresponding to angled surface 20 is slightly less than the desired 15° sharpening angle. Accordingly, the angle $\beta$ corresponding to the angled surface 22 is slightly less than the desired 20° sharpening angle. In this specific example, the surfaces 20 and 22 are intended to provide an angle set up of 15° and 20°, respectively. As such, the angle $\alpha$ is actually slightly less than 15° (e.g., 13.78°) so that when the thickness of the blade 82A is added to the angle $\alpha$, the cutting edge point of contact 84A of the blade with the sharpening rod 16 is exactly the intended 15° (See FIG. 7B). The same concept applies for the angle $\beta$ for angled surface 22. Here the angle $\beta$ is actually slightly less than the intended angle of 20° (e.g., 18.78°) so that when the thickness of blade 82B is added to the angle $\beta$, the cutting edge point of contact 84B of the blade with the sharpening rod is exactly the intended 20°.

Figure 8:
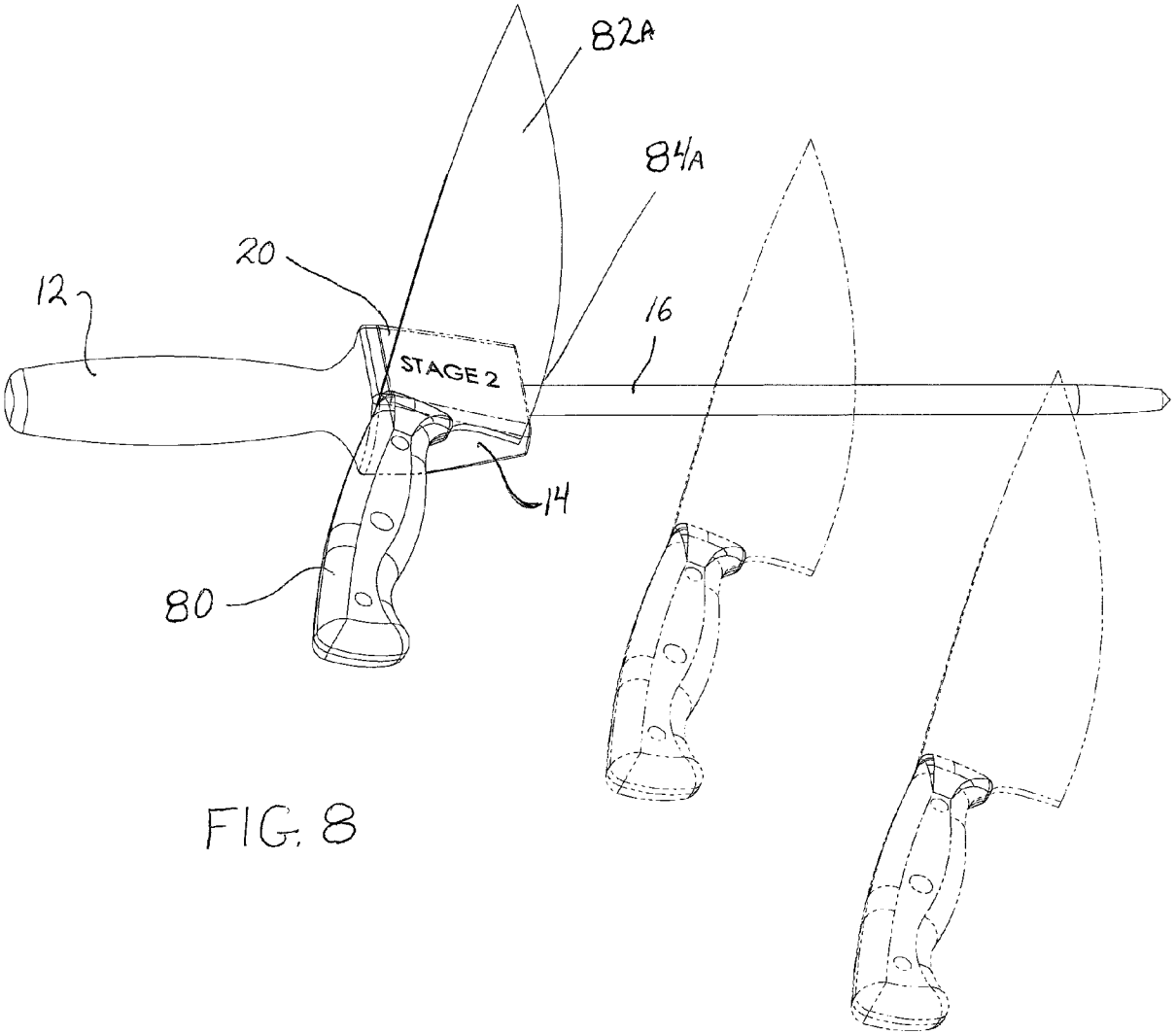
FIG. 8 is a diagram showing an example of the knife sharpener of the present principles in use.

FIG. 8 shows an example of the sharpener 10 in operation for sharpening a knife 80. The knife 80 includes a blade 82A that is positioned flat on the angled bolster surface 20. In this manner, the point of contact 84A between the cutting edge of blade 82A and the sharpening rod 16 is exactly the 15° intended for surface 20. Once so positioned, the user may continue with the ordinary sharpening action (i.e., moving the blade away from the handle 12) while maintaining the initially positioned angle as set up by the angled surface 20 of bolster 14. In this manner, the cutting edge of the blade 82A is sharpened at the predetermined 15° angle.

As shown in the examples above, the bolster portion 14 is part of or integrated into the handle 12. In other contemplated implementations, it is envisioned that the bolster portion can be a separate add-on device (e.g., a separate accessory) that can be selectively attached to an existing sharpening device surface and does not include the handle. In one implementation, the bolster portion 14 can be configured to be releasably positioned/connected to the sharpening rod of a conventional knife sharpener at a point adjacent a corresponding handle. In another implementation, the bolster portion 14 can be configured to releasably attached to the handles of existing knife sharpening rods.

In another alternative implementation, the handle 12 is further configured to include mechanical means for securing the knife sharpener to a stationary or fixed object (e.g., a table, mounted cutting board, or the like). In this implementation, the mechanical means can include, for example, a clamping system or other type of complementary engagement with the stationary object. Once secured to the stationary of fixed object, the knife sharpener would become immovable when in use with respect to the cutting implement being sharpened. This would eliminate the chance of the sharpener shifting or moving relative to the action of the manual sharpening. By securing the sharpener to a fixed object, the possibility of variations in the sharpening angle, after the blade moves away from the initial guide provided by the angled bolster, is essentially reduced and practically eliminated.

Figure 9:
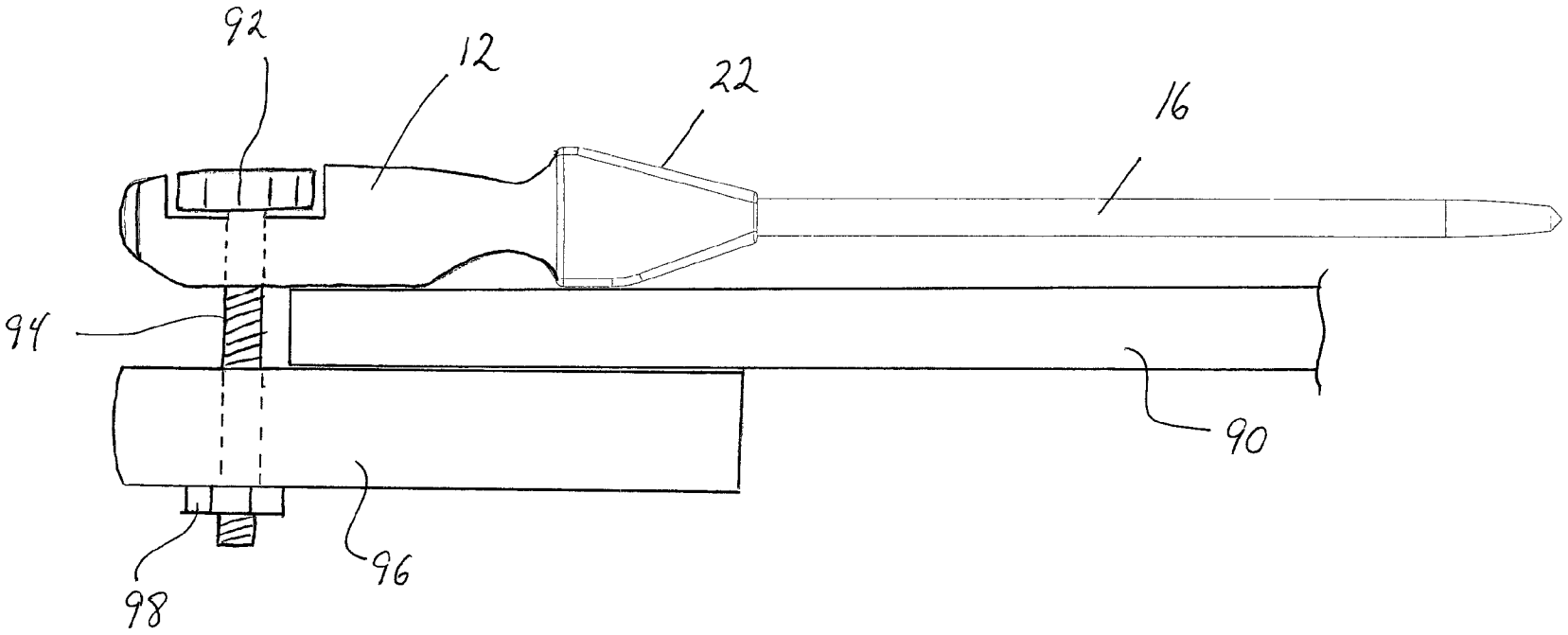
FIG. 9 shows a diagram of the knife sharpener according to yet another implementation of the present principles.

Referring to FIG. 9, there is shown the knife sharpener according to yet another implementation of the present principles. In this implementation, handle 12 includes a dial or knob 92 which is connected to a threaded shaft 94. As shown, a block 96 is positioned on the underside of a table 90 or other fixed surface, and the threaded shaft 94 passes through a hold in the block 96 and is secured using a nut 98. In this configuration, the handle 12 is secured to the table 90 and thereby allows the use of the angled surface 22 and sharpening rod 16 without concern of any movement of the same. In this implementation, the handle 12 is secured with angled surface 22 facing upward for use with the sharpening rod. Accordingly, the handle 12 may be configured to allow either angled surface 20 or 22 to be facing upward once fixed to the table 90. Those of skill in the art will also appreciate that other securing or clamping mechanisms could be used to secure the handle 12 with angled bolsters to a fixed surface without departing from the spirit of the present principles. In another alternative implementation, at least one of the angled surfaces 20 or 22 of the angled bolster 14 can be configured to receive one or more attachments. These attachments would be configured to "add" to the initial angular value and thereby provide the user with the ability to adjust the angled position set up by the angled surfaces of the bolster. For example, the attachments could be configured in 2.5° increments, so the user may selectively change the angle of the surfaces 20 or 22 of the bolster depending on the edge of the cutting implement being sharpened.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A knife sharpener having a knife sharpening portion; the sharpener comprising:

an angled bolster portion positioned at one end of the sharpening portion and having a first angled surface and a second angled surface sloped toward the sharpening portion, each of the first and second angled surfaces having an angle of inclination of less than 30 degrees such that said first and second angled surfaces are different from each other and configured to support and position a cutting edge of blade to be sharpened at a first and second predetermined sharpening angle, respectively, with respect to the sharpening portion.

2. The knife sharpener according to claim 1, wherein a second of the two predetermined angular surfaces is configured to be positioned on an opposite side of the sharpening portion as a first of the two predetermined angular surfaces.

3. A knife sharpener comprising:

a handle;

an angled bolster portion integrated into one end of the handle and having at least two separate and distinct angled surfaces; and a sharpening rod axially extending away from the angled bolster portion;

wherein said at least two angled surfaces have angles of inclination less than 30 degrees and are configured to provide two different and distinct predetermined sharpening angles less than 30 degrees to a cutting edge of a blade to be sharpened.

4. The knife sharpener according to claim 3, wherein said second angled surface having a different angular disposition than said at least one angular surface with respect to the sharpening rod.

5. The knife sharpener according to claim 3, wherein said angled bolster is integrated into said handle.

6. The knife sharpener according to claim 3, further comprising means for securing said handle to a stationary surface.

7. A knife sharpener comprising:

a handle having an area for receiving a user's hand and two opposing ends;

an angled bolster portion integrated into one end of the handle opposite said area for receiving the user's hand and having a first angled surface and a second angled surface positioned opposite said first angled surface; and a sharpening rod connected to the angled bolster portion and axially extending away therefrom;

wherein said first and second angled surfaces are configured to provide first and second different and distinct predetermined sharpening angles each being less than 30 degrees to a cutting edge of a blade to be sharpened.

8. The knife sharpener according to claim 7, wherein said sharpening rod is removable from said handle.

9. The knife sharpener according to claim 7, further comprising means for securing said handle to a stationary surface.

* * * * *